United States Patent [19]

Kliesch et al.

[11] 4,243,630

[45] Jan. 6, 1981

[54] FLUID CATALYTIC CRACKING UNIT YIELD MONITOR

[75] Inventors: Howard C. Kliesch, Thousand Oaks, Calif.; Daniel N. McWilliams, Baton Rouge, La.; Roy E. Pratt, Groves, Tex.; Donald H. Schmude, Trumbull, Conn.

[73] Assignee: Texaco Inc., White Plains, N.Y.

[21] Appl. No.: 21,651

[22] Filed: Mar. 19, 1979

[51] Int. Cl.[3] ..... C10G 21/00; G06G 7/58

[52] U.S. Cl. ..... 422/62; 23/230 A; 196/46; 364/501; 422/119

[58] Field of Search ..... 422/62, 119; 23/230 A; 196/14.52, 46; 364/497, 501

[56] References Cited

U.S. PATENT DOCUMENTS

| | | | |
|---|---|---|---|
| 3,799,871 | 3/1974 | Sequeira, Jr. | 196/14.52 X |
| 4,053,744 | 10/1977 | Woodle | 196/14.52 X |

*Primary Examiner*—R. E. Serwin

*Attorney, Agent, or Firm*—Carl G. Ries; Robert A. Kulason; Ronald G. Gillespie

[57] ABSTRACT

A monitor determines the yields of constituents of a product provided by a fluid catalytic cracking unit (FCCU) receiving fresh feed and recycle feed. The monitor includes sensors providing signals corresponding to sensed operating parameters of the FCCU. Analyzers analyze the fresh feed and the recycle feed and provide signals corresponding to the API gravities of the fresh and recycle feeds and to the viscosities of the fresh and recycle feeds. A circuit provides signals corresponding to the Watson K factors associated with the fresh and recycle feeds and the catalyst in accordance with the signals from the analyzers and sensors. A network provides signals representative of the yields of the constituents of the product from FCCU. Display apparatus provides a visual display of the yields.

11 Claims, 9 Drawing Figures

FLUE GAS
REGENERATOR
AIR
FURNACE
FUEL GAS
FURNACE
FUEL GAS
GRAV. ANAL.
VIS. ANAL.
FEED STOCK
REACTOR
LEVEL SENSOR
STRIPPER
LP SEPARATOR
LIQUID NAPHTHA
GAS
ICGO
HVY GAS OIL
PRIM. FRACT.
VIS. ANAL.
GRAV. ANAL.
MONITOR MEANS 70

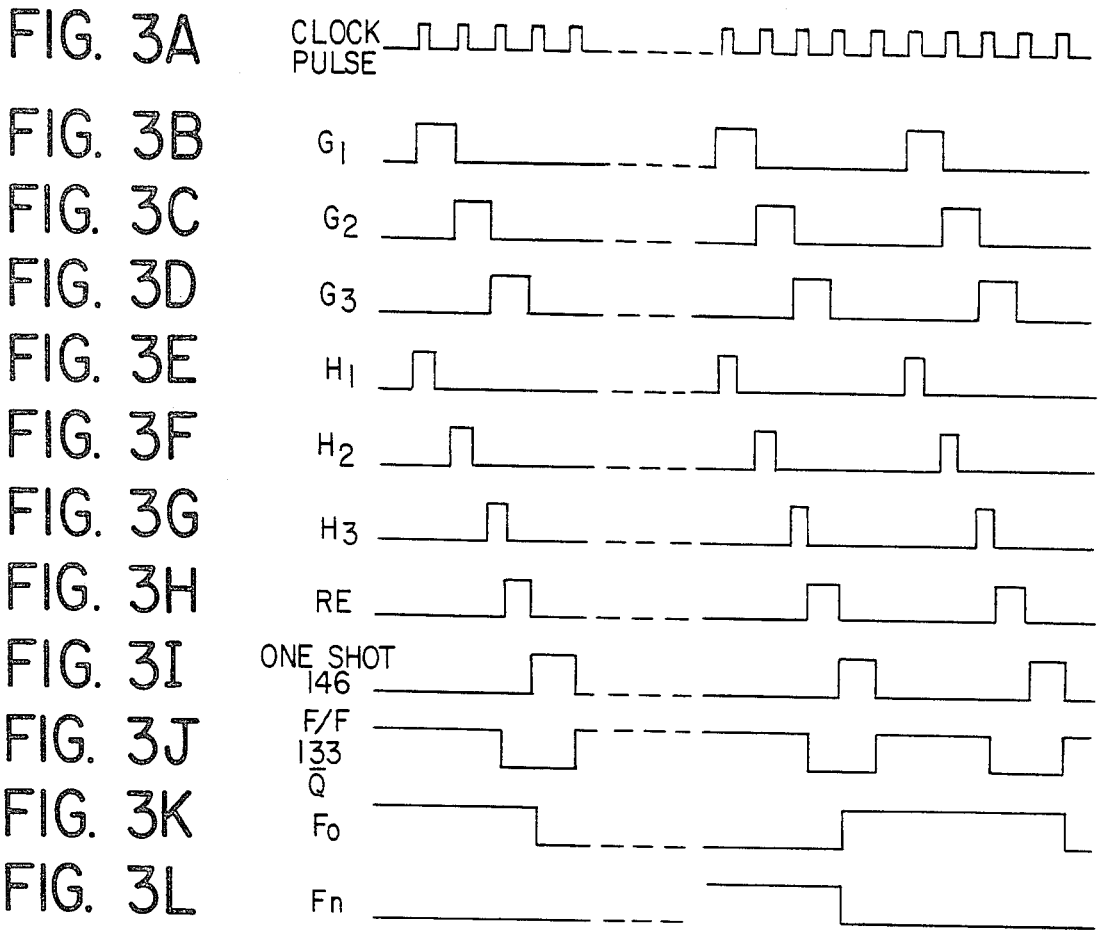
FIG. 7
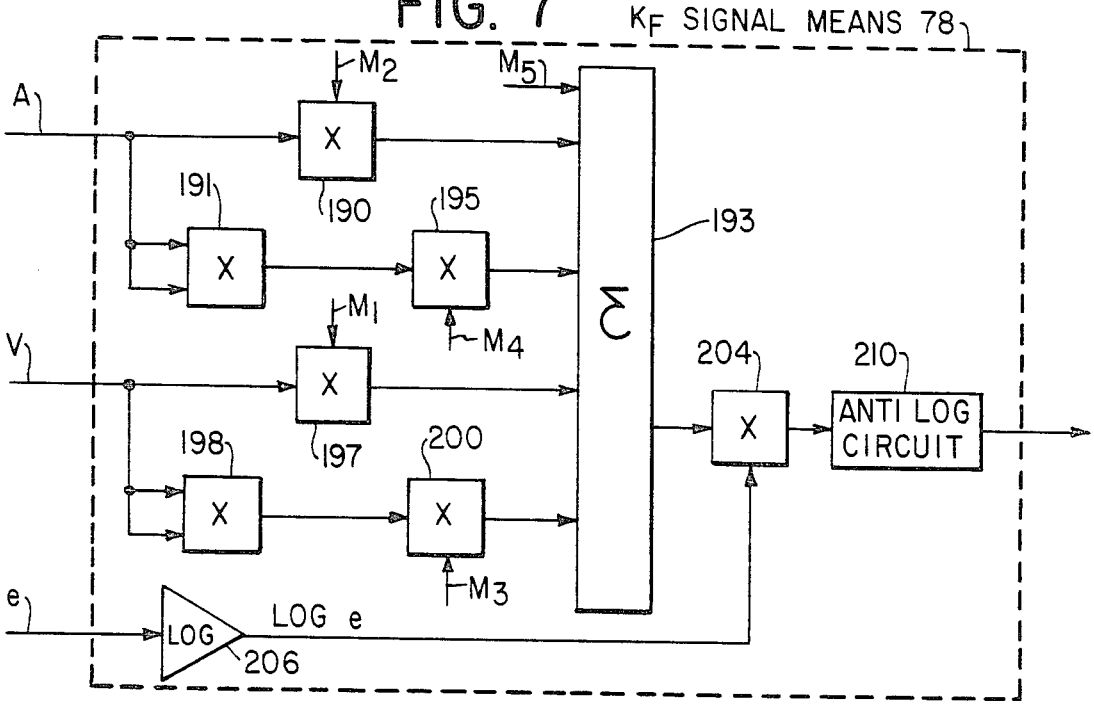

FLUID CATALYTIC CRACKING UNIT YIELD MONITOR

BACKGROUND OF THE INVENTION

1. Field of the Invention

The present invention relates to monitors in general and, more particularly, to monitors for refining units.

SUMMARY OF THE INVENTION

A monitor determines the yields of constituents of a product provided by a fluid catalytic cracking unit (FCCU) receiving fresh feed and recycle feed. The monitor includes sensors providing signals corresponding to sensed operating parameters of the FCCU. Analyzers analyze the fresh feed and the recycle feed and provide signals corresponding to the API gravities of the fresh and recycle feeds and to the viscosities of the fresh and recycle feeds. A circuit provides signals corresponding to Watson K factors associated with the fresh and recycle feeds and the catalyst in accordance with the signals from the analyzers and sensors. A network provides signals representative of the yields of the constituents of the product from FCCU. Display apparatus provides a visual display of the yields.

The objects and advantages of the invention will appear more fully hereinafter, from the consideration of the detailed description which follows, taken together with the accompanying drawings wherein one embodiment is illustrated by way of example. It is to be expressly understood, however, that the drawings are for illustrative purposes only and are not to be construed as defining the limits of the invention.

DESCRIPTION OF THE DRAWINGS

FIGS. 3A through 3L are graphical representations of voltages occurrig during operation of the monitor means shown in FIG. 1.

FIGS. 4 through 9 are detailed block diagram of the control signal means, the B & C signal means, the conversion signal means, the K signal means, the yield signal means and the A, K and $C_T$ signal means, respectively, shown in FIG. 2.

DESCRIPTION OF THE INVENTION

Figure 1:
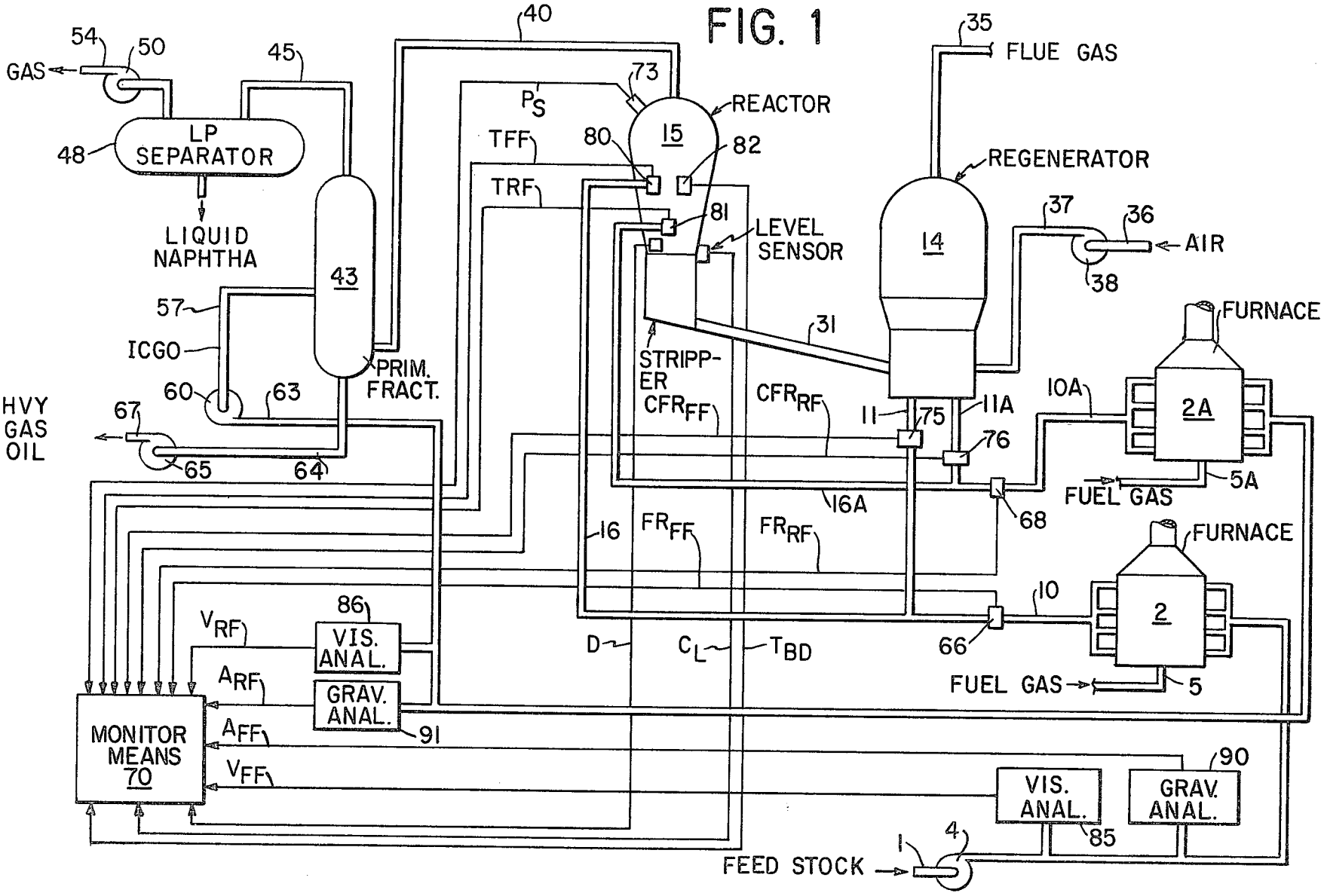
FIG. 1 shows a fluid catalytic cracking unit in a partial schematic form and a yield monitor, constructed in accordance with the present invention, in simplified block diagram form.

Referring to FIG. 1, there is shown a fluid catalytic cracking unit (FCCU). Only those elements pertaining to the disclosure of the present invention are shown. Other elements which are not necessary to the present invention are omitted for ease of explanation. Fresh feed, which may be a gas oil, in a line 1 is pumped into a furnace 2 by a pump 4. The flow rate of the gas oil in line 1 is determined by overall refinery operation and is not controlled by the system of the present invention. Therefore, the driving means for pump 4 is not shown. The feedstock is heated to a predetermined temperature by furnace 2 and leaves by a line 10.

Recycle feed, which is an intermediate cycle gas oil in a line 63 is also heated to a predetermined temperature by a furnace 24 and leaves by a line 10A. Lines 11, 11A carry fluid catalyst from a regenerator 14, said catalyst commingles with the heated feedstock before entering a reactor 55 through lines 16 and 16A.

Spent catalyst leaves reactor 15 fed by gravity through a line 31, after passing through a steam stripper which is shown as being part of reactor 15, to regenerator 14. The catalyst is revitalized in regenerator 14 by burning coke deposits from it. The quantity of air entering a line 36 and being pumped into regenerator 14 through a line 37 by a blower 38 controls the burning rate of the coke deposits.

Effluent from reactor 15 leaves by way of a line 40 to a primary fractionator 43. The top product of fractionator 43 leaves by way of a line 45 and enters a low pressure separator 48. Separator 48 provides liquid naphtha and gas. The gas is provided to a gas compressor 50 which discharges the gas into a line 54.

Another output from primary fractionator 59 is intermediate cycle gas oil which leaves primary fractionator 43 by way of line 57. A pump 60 pumps all the intermediate cycle gas oil through a line 63 for use as the recycle feed. Heavy cycle gas oil is provided by fractionator 43 by way of line 64 to a pump 65 where it is provided to a line 67 as product.

Flow sensors 66 and 68 sense the flow rates of the fresh feed and of the recycle feed in lines 10 and 10A, respectively, and provide corresponding signals $FR_{FF}$ and $FR_{RF}$, respectively, to monitor means 70. Monitor means 70 in determining the yield of the constituents of the FCCU product and providing a corresponding display and printout utilizes the following equations:

$$K_F = e^{(M0+M1VF+M2AF+M3VF^2+M4AF^2)} \quad (1)$$

where $K_F$ is the Watson K factor for either the fresh feed and the recycle feed, V is viscosity of the feed, A is API gravity of the feed and $M_0$ through $M_4$ are constants having values of 2.257, $0.304\times10^{-3}$, $0.916\times10^{-2}$, $0.71\times10^{-7}$ and $0.569\times10^{4}$, respectively.

$$K_T=[(K_{FF})(FR_{FF})+(K_{RF})(FR_{RF})]/(FR_{FF}+FR_{RF}) \quad (2)$$

where $FR_{FF}$ and $FR_{RF}$ are flow rates of the fresh feed and the recycle feed, respectively. It should be noted that $K_{FF}$ is the $K_F$ factor associated with fresh feed, as determined in accordance with equation 1, while $K_{RF}$ is the $K_F$ factor associated with the recycle feed as determined in accordance with equation 1. $K_T$ is the K factor for the total feed.

$$K_{BD}=(C_F)(D_{RF})+(1.0-C_F)(K_T) \quad (3)$$

where $C_F$ is the fraction of catalyst contacting reactor 15 bed feed and $K_{BD}$ is the K factor associated with the reactor bed.

$$C_F=C/C_T \quad (4)$$

$$C_T=[(L_1)(C_L)+(L_2)(C_L)^2-(L_3)(C_L)^3]D \quad (5)$$

where $C_L$ is the level or height of the catalyst in reactor 15; $C_T$ is the catalyst inventory in reactor 15, C is the catalyst inventory for a predetermined catalyst level, and $L_1$, $L_2$ and $L_3$ are constants having preferred values of 283.6377, 10.63038 and 0.0158488.

The gravity $A_{BD}$ of the catalyst bed feed in reactor 15 is determined as follows:

$$A_T=[(A_{FF})(FR_{FF})+(A_{RF})(FR_{RF})]/(FR_{FF}+FR_{RF}). \quad (6)$$

where $A_T$ is the gravity of the total feed.

$$A_{BD}=(C_F)(A_{RF})+(1.0-C_F)(A_T). \quad (7)$$

$$\text{Yield} = (Y_{FF})([FR_{FF}+FR_{RF}]) + (Y_{RF}+Y_{RB})[FR_{RF}/(FR_{FF}+FR_{RF})] \quad 8.$$

where Y is the yield of a particular component of the product leaving reactor 15 through line 40, $Y_{FF}$ is the yield affected by the fresh feed, $Y_{RF}$ is the yield affected by the recycle feed, $Y_{RB}$ is the yield affected by the reactor bed, FF is the fresh feed, RF is the recycle feed and TF is the $$Y=e^{(B0+B1K+B2A+B3ACT+B4(CV)+B5(CV)2)} \quad (9)$$

$B_0$ through $B_5$ are constants whose values differ for different components. ACT is a catalyst parameter and CV is an interim factor.

$$CV = e^{(C0+C1K+C24+C3ACT+C4(C10)} + C_5SPV + C_6(P+J_4) + C_7(T+J_3) \quad 10.$$

where C/O is the ratio of catalyst to oil, SPV is the space velocity of oil, P is the top pressure in reactor 15, T is the user outlet temperature, constants $C_0$ through $C_7$ whose values differ in accordance with the zone of activity, namely the fresh feed riser, the recycle feed riser and the reactor bed and $J_3$ and $J_4$ are constants having preferred values of 459.696 and 14.7, respectively.

The following tables show values for constants $B_0$ through $B_5$ and $C_0$ through $C_7$ for a particular FCCU unit.

TABLE 1

| DESCRIPTION FRESH FEED RISER | $B_0$ | $B_1$ | $B_2$ | $B_3$ | $B_4$ | $B_5$ |
|---|---|---|---|---|---|---|
| DRY GAS (C2& LTR) | −2.30979 | 0.0 | 0.0 | 0.03577 | 1.71483 | 0.0 |
| PROPANE | −1.53047 | 0.0 | 0.0 | 0.0 | 0.0 | 0.49139 |
| PROPENE | 64.42380 | −6.08412 | 0.32241 | 0.01190 | −9.70263 | 1.64455 |
| ISOBUTANE | −0.64589 | 0.0 | 0.0 | 0.0 | 2.55195 | 0.0 |
| N-BUTANE | 4.47113 | 0.0 | 0.18062 | −0.05868 | −49.95689 | 7.13526 |
| BUTENES | 49.21059 | −4.69456 | 0.28530 | 0.0 | −6.95102 | 1.32267 |
| DB NAPHTHA | 1.44133 | 0.0 | 0.0 | 0.0 | 7.85513 | −0.17608 |
| GAS OIL | 4.52862 | 0.0 | 0.0 | 0.00083 | −0.38114 | −0.15552 |
| COKE | −3.84939 | 0.0 | 0.0 | 0.0 | 9.04422 | 0.0 |
| RECYCLE RISER | | | | | | |
| DRY GAS (C2&LTR) | −2.57082 | 0.0 | 0.0 | 0.0 | 10.76330 | −0.65813 |
| PROPANE | −088440 | 0.0 | −0.11428 | 0.0 | 11.64750 | −0.90536 |
| PROPENE | −13.91040 | 0.0 | 0.32545 | 0.11411 | 19.88100 | −2.56257 |
| ISOBUTANE | −0.15784 | 0.0 | −0.02996 | −0.03801 | 10.66689 | −0.98886 |
| N-BUTANE | −12.23980 | 0.26084 | 0.11129 | 0.05872 | 22.82639 | −2.65201 |
| BUTENES | −2.57020 | 0.0 | −0.03623 | 0.0 | 21.30939 | −2.62282 |
| DB NAPHTHA | 1.09555 | 0.0 | 0.0 | −0.01076 | 10.98320 | −1.26982 |
| GAS OIL | 4.70484 | −0.01209 | 0.00131 | 0.0 | −0.91157 | −0.05661 |
| COKE | 1.34589 | 0.0 | 0.0 | 0.0 | 0.53861 | 0.0 |
| REACTOR BED | | | | | | |
| DRY GAS (C2&LTR) | 0.05796 | 0.0 | 0.0 | 0.0 | 0.56293 | 0.0 |
| PROPANE | 4.86979 | −0.60671 | 0.02374 | 0.0 | 5.56293 | 0.0 |
| PROPENE | 15.43330 | −2.45580 | 0.19657 | 0.0 | 31.96298 | −3.12730 |
| ISOBUTANE | 6.39845 | −0.67700 | 0.0 | 0.0 | 6.75617 | −0.53516 |
| N-BUTANE | 4.35822 | −0.17452 | −0.07511 | −0.06534 | 3.06480 | −0.17723 |
| BUTENES | −15.64660 | 0.14342 | −0.08061 | 0.0 | 5.58369 | −0.49185 |
| DB NAPHTHA | −1.35395 | 0.15254 | 0.02157 | 0.0 | 5.98309 | −0.44889 |
| GAS OIL | 4.58288 | 0.0 | 0.0 | 0.0 | −0.64254 | 0.02649 |

TABLE II

| COEFFICIENT | F F RISER | R F RISER | RX BED |
|---|---|---|---|
| $C_0$ | −20.73769 | −23.82010 | −31.77269 |

TABLE II-continued

| COEFFICIENT | F F RISER | R F RISER | RX BED |
|---|---|---|---|
| $C_1$ | 1.69232 | 0.18577 | 0.66364 |
| $C_2$ | −0.14051 | 0.12245 | 0.15150 |
| $C_3$ | 0.0 | 0.02684 | 0.0 |
| $C_4$ | 0.00573 | 0.01123 | 0.00146 |
| $C_5$ | −0.12578 | −0.15060 | −0.11845 |
| $C_6$ | 0.0 | 0.0 | −0.09957 |
| $C_7$ | 0.00634 | 0.01578 | 0.02056 |

Monitor means 70 receives a signal P corresponding to the sensed top pressure of reactor 15 from a conventional type pressure sensor 73. Sensors 75 and 76 permit the determination of flow rates of the catalyst in line 11 and 11A, respectively, and provide signals $CFR_{FF}$ and $CFR_{RF}$, respectively, to monitor means 70. Temperature sensors 80, 81, 82 sense the outlet temperatures of the risers 16, and 16A and the catalyst bed, respectively, in reactor 15, and provide signals $T_{FF}$, $T_{RF}$ and $T_{BD}$, respectively, corresponding to the sensed temperatures to monitor means 70. A catalyst level sensor 83 provides a signal $C_2$ corresponding to the level of the catalyst's bed in reactor 15, while a density sensor 84 provides a signal D representative of the density of the bed.

Viscosity analyzers 85 and 86, which may be of a conventional type, sample the fresh feed and the recycle feed in lines 1 and 63, respectively, corresponding to the viscosities of the fresh feed and the recycle feed, respectively, to monitor means 70. Gravity analyzers 90, 91 sample the fresh feed and the recycle feed in lines 1 and 63, respectively, and provide signals $A_{FF}$ and $A_{RF}$, respectively, corresponding to the API gravity of the fresh feed and the recycle feed, respectively, to monitor means 70. Monitor means 70 provides both a visual display and a printout of the yield of the various constituents of the product leaving reactor 15.

Figure 2A:
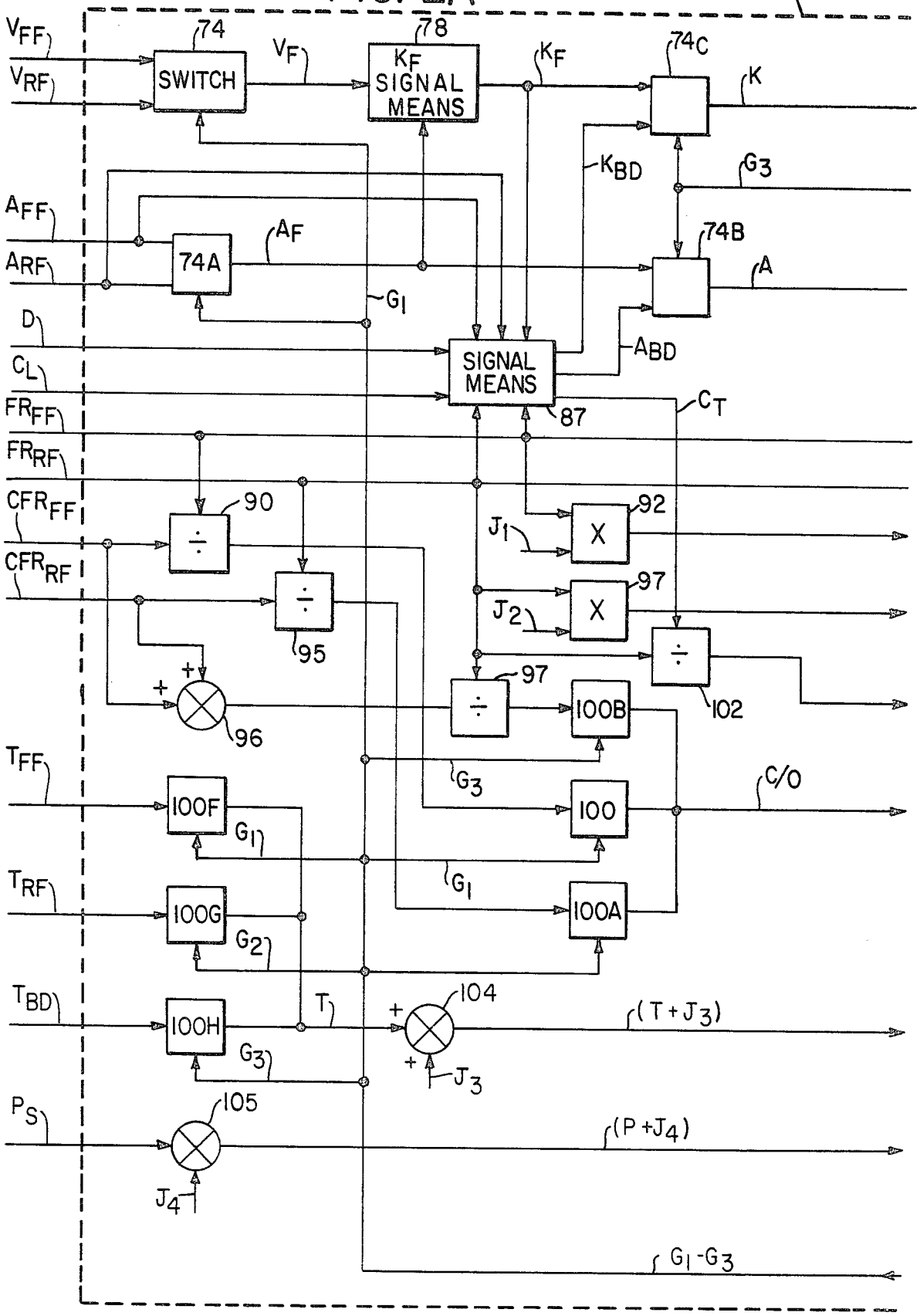
FIGS. 2A and 2B constitute a detailed block diagram of the monitor means shown in FIG. 1.
Figure 2B:
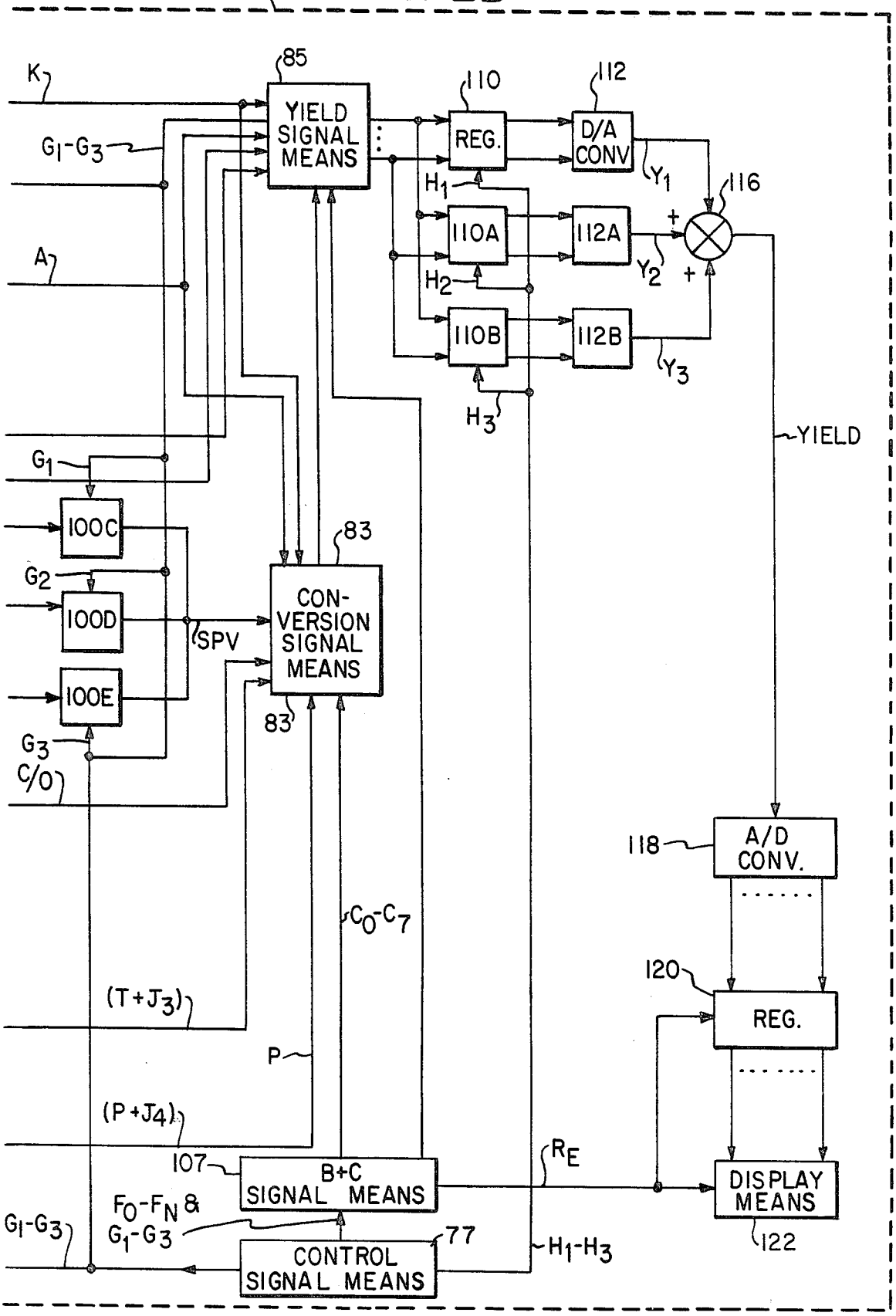

Referring now to FIGS. 2A, 2B and 3, monitor means 70 includes an electronic switch 74 receiving signals $V_{FF}$ and $V_{RF}$ and a control signal $G_1$, shown in FIG. 3B, from control signal means 77. Switch 74 is in effect a single pole double throw switch which selects between signals $V_{RF}$ and $V_{FF}$ to provide a signal $V_F$ to $K_F$ signal means 78. When signal $G_1$ is at a high logic level, switch 74 provides signal $V_{FF}$ as signal $V_F$ to $K_F$ signal means 78. When signal $G_1$ is at a low logic level, switch 74 provides signal $V_{RF}$ as signal $V_F$ to $K_F$ signal means. Similarly, switch 74A is responsive to signal $G_1$ to provide signal $A_{FF}$ as a signal $A_F$ to another switch 74C, when signal $G_1$ is at a high logic level and to provide signal $A_{RF}$ as signal $A_F$ to switch 74C when signal $G_1$ is at a low logic level. Switch 74B is controlled by signal $G_3$. $K_F$ signal means 78 provides a signal $K_F$ to switch 74C, also controlled by signal $G_2$, as hereinafter explained, to conversion signal means 83, to yield signal means 85 and to A, K & $C_T$ signal means 87. Switches 74B and 74C provide signals A and K, respectively, to yield signal means 85 and to conversion signal means 85. Signal means 87 provides signals A, K and $C_T$ as hereinafter explained.

All elements having the same numeric identification with a different suffix are similar in construction and operation to those elements having the same numeric designation but with no suffix.

Signals $FR_{FF}$ and $FR_{RF}$ are provided to conversion signal means 83 and to yield signal means 85. Signal $FR_{FF}$ is also provided to a divider 90, a multiplier 92 from signal $FR_{RF}$ is also provided to a divider 95 and to a multiplier 97. Signals $CFR_{FF}$ and $CFR_{RF}$ are provided to dividers 90 and 95, respectively, where they are multiplied with signals $FR_{FF}$ and $FR_{RF}$, respectively, and to summing means 96. Dividers 90, 95 provide signals corresponding to the catoil ratios for the fresh feed and for the recycle feed, respectively. Summing means 96 provides a sum signal to another divider 97 where it is divided by signal $FR_{RF}$ to provide yet a third signal corresponding to a catoil ratio for the reactor bed. Dividers 90, 95 and 97 provide signals to switches 100, 100A and 100B, respectively, which are controlled by control signals $G_1$, $G_2$ and $G_3$, respectively. Switches 100, 100A and 100B are electronic single pole throw switches that are rendered conductive to pass a signal when a control signal $G_1$, $G_2$ or $G_3$ is at a high logic level and rendered non-conductive to block the signal when the control signal $G_1$, $G_2$ or $G_3$ is at a low logic level. The outputs of switches 100, 100A and 100B are tied together so that they provide a signal C/O to conversion signal means 83.

A divider 101 divides a signal $C_T$ provided by signal means 87 into signal $FR_{RF}$ to provide a space velocity signal. Multipliers 92 and 97 multiply signals $FR_{FF}$ and $FR_{RF}$ with direct current voltages $J_1$ and $J_2$ corresponding to values of 0.002079 and 0.002303, respectively, to provide signals corresponding to the space velocity of the fresh feed and of the recycle feed, respectively. The signals from multipliers 92, 97 and divider 102 are provided to switches 100C, 100D and 100E, respectively, whose outputs are tied together so that they may provide a signal SPV to conversion signal means 83. Switches 100C, 100D and 100E are controlled by signals $G_1$, $G_2$ and $G_3$, respectively.

Switches 100F, 100G and 100H receive signals $T_{FF}$, $T_{RF}$ and $T_{BD}$, respectively, and are controlled by signals $G_1$, $G_2$ and $G_3$, respectively, to pass one of them as a temperature signal T to summing means 104 where it is summed with a direct current voltage $J_3$, corresponding to a value of 459.646, to provide a signal $(T+J_3)$ to conversion signal means 83. Summing means 105 sums signal P with a direct current voltage $J_4$ to provide a signal $(P+J_4)$ to conversion signal means 83. Voltage $J_4$ corresponds to a value of 14.7.

Control signal means 77 provides control signals $F_1$ through $F_n$, and $G_1$ through $G_3$, as hereinafter explained, to B and C signal means 97. B and C signal means 107 provides signals $B_0$ through $B_5$ corresponding to the constants in equation 9 and signals $C_0$ through $C_7$ corresponding to the constants in equation 10. Signals $C_0$ through $C_7$ are applied to conversion signal means 83 while signals $B_0$ through $B_5$ are applied to yield signal means 85.

Conversion signal means 83 provides signal CV, corresponding to a conversion factor, to yield signal means 85, which also receives signals $G_1$ through $G_3$. Yield signal means 85 provides digital signals to register 110, 110A and 110B corresponding to the yield of a particular element as hereinafter explained. Control signal means 77 provides control signals $H_1$, $H_2$ and $H_3$ to register 110, 110A and 110B corresponding to the yield of a particular element as hereinafter explained. Control signal means 77 provides control signals $H_1$, $H_2$ and $H_3$ to registers 110, 110A and 110B, respectively, to cause those registers to enter the digital signals when they are at a high logic level. Registers 110, 110A, 110B provide digital signals to digital-to-analog converters 112, 112A and 112B, respectively, which in turn provide analog signals $Y_1$, $Y_2$ and $Y_3$ to provide signal Y corresponding to the yield of a particular component of the product from reactor 15. Signal Y is converted to digital signals by an analog-to-digital converter 118 and applied to a register 120 receiving a signal RE, shown in FIG. 3H, from B and C signal means 97. Signal RE is also applied to display means 122 which provides a display and printout of the yield of the particular component.

Figure 4:
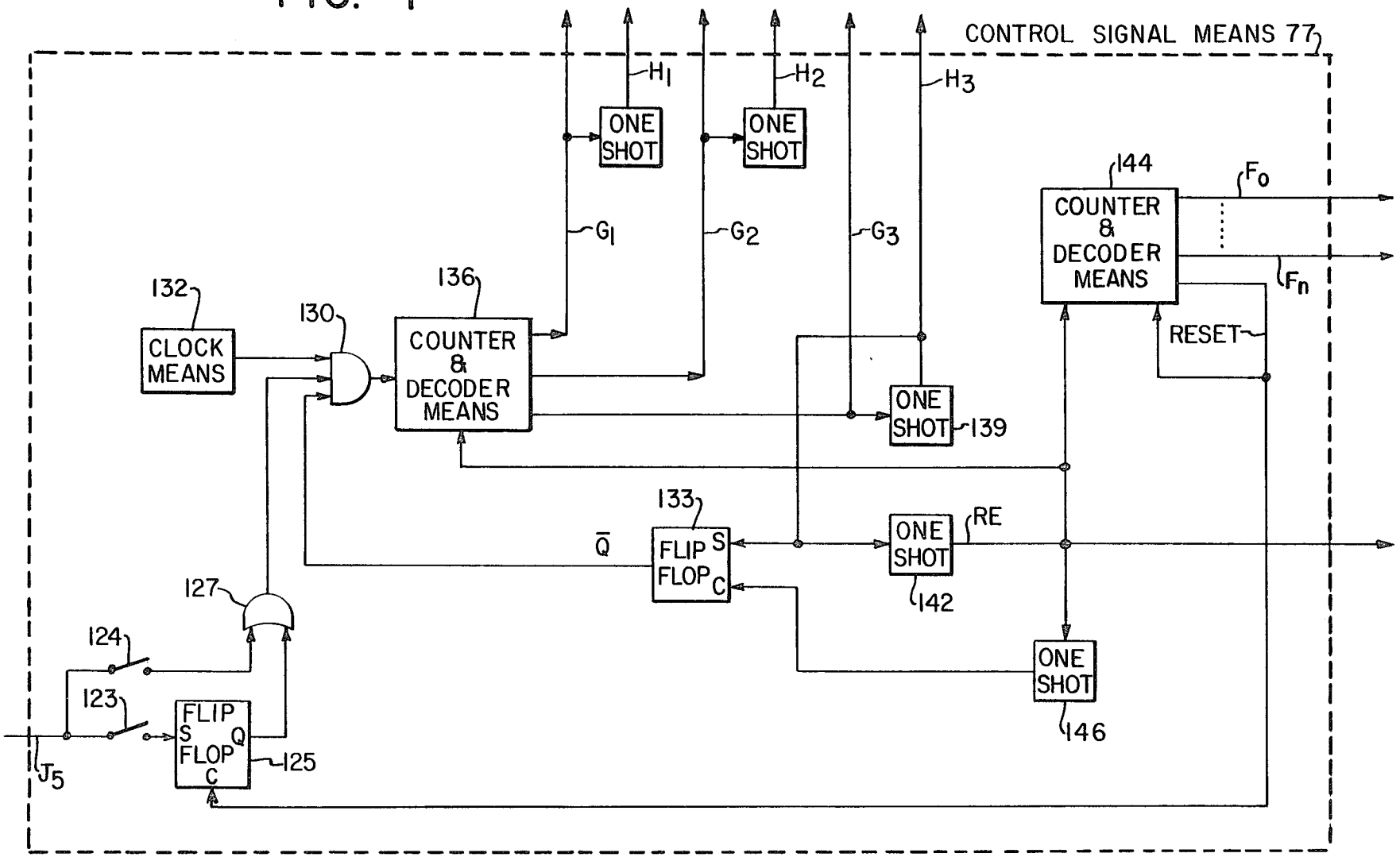

Referring now to FIGS. 3 and 4, control signal means 77 includes a manually operative momentary single pole switch 123 receiving a direct current voltage $J_5$ which is at a high logic level and a manually operative single pole, single throw switch 124 also receiving voltage $J_5$. The purpose of switch 124 is to select between two modes of operation, when switch 124 is open, the monitor operates for one cycle, that is an operator initiates the action and upon the completion of determination of the yields of all components of the product, the operation is terminated. In a closed position, switch 124 permits the determining of component yield on a periodic basis as hereinafter explained. For purpose of illustration, the manual control method will be explained first and then modified for the periodic operation.

With switch 124 open and upon switch 123 being momentarily closed by an operator, switch 120 provides a pulse which triggers a flip-flop 125 to a set state. As used hereinafter a flip-flop has two outputs, a Q output and a $\overline{Q}$ output. The Q output is at a high logic level when the flip-flop is in a set state and at a low logic level when the flip-flop is in a clear state. The opposite is true for the $\overline{Q}$ output. It should be noted that only those flip-flop outputs that are necessary for an understanding of the invention are described. The Q output of flip-flop 125 being at a high level passes through an OR gate 127 and enables an AND gate 130. AND gate 130 also receives a $\overline{Q}$, output as shown in FIG. 3J, from a flip-flop 133. The $\overline{Q}$ output of flip-flop 133 is initially at a high logic level so that upon the occurrence of the Q output from flip-flop 125 going to a high logic level, AND gate 130 passes the clock pulses to a counter and decode means 136. Counter and decode means 136 provides control signal $G_1$, $G_2$ and $G_3$ as shown in FIGS. 3B, 3C and 3D, respectively. One-shots 137, 138 and 139 provide control signals $H_1$, $H_2$ and $H_3$, respectively, as shown in FIGS. 2E, 2F and 2G, respectively. Signal $H_3$ is applied to the set input of flip-flop 133 triggering it to a set condition causing output $\overline{Q}$ to go to a low logic level. AND gate 130 is disabled while output $\overline{Q}$ from flip-flop 133 is at a low logic level.

Signal $H_3$ upon its completion also triggers another one-shot multivibrator 142 which provides signal RE for the entry of information into register 110.

Pulse RE also triggers a one-shot multivibrator 146 which provides a pulse, as shown in FIG. 3I, that clears flip-flop 133 causing the $\overline{Q}$ output to go to a high logic level thereby enabling AND gate 130 to continue to pass clock pulses. Signal RE also resets counter and decode means 136 and is counted by counter and decode means 144. Counter and decode means 144 provides control signals $F_0$ through $F_n$ as shown in FIGS. 2K and 2L, in response to signal RE, respectively.

In normal operation, when the last control signal $F_n$ of a cycle is at a high logic level, the next RE pulse counted by counter and decode means 144, causes control signal $F_n$ to go to a low level and causes a reset signal to be provided to counter and decode means 144 and to flip-flop 125. Flip-flop 125 is cleared causing its Q output to go to a low logic level thereby disabling AND gate 130 until switch 120 is depressed again.

Figure 5:
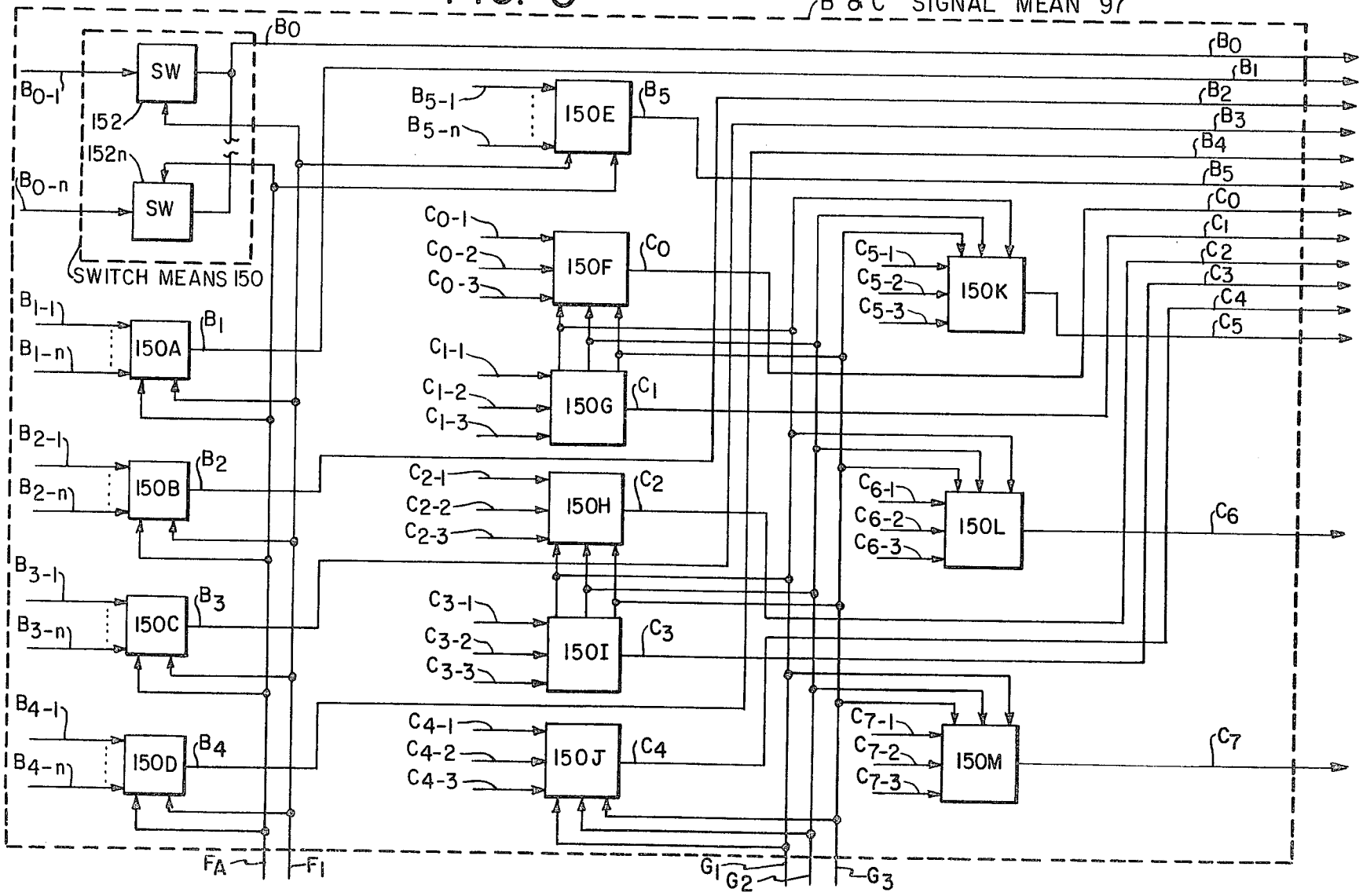

Referring now to FIG. 5, B and C signal means 97 is in effect memory means including a plurality of switches receiving various direct current voltages corresponding to constants having values shown in Tables I and II. For example, switch means 150 is shown as having electronic switches 152 and 152N. Switch 152 receives direct current voltage $B_{0\text{-}1}$ and control signal $F_1$. When control signal $F_1$ is at a high logic level, switch 152 is rendered conductive to pass voltage $B_{0\text{-}1}$ which is provided as signal $B_0$. When signal $F_1$ is at a low logic level, switch 152 does not pass voltage $B_{0\text{-}1}$. Similarly when control signal $F_n$ is at a high logic level, switch 152N will pass direct current voltage $B_{0\text{-}N}$ and provide it as signal $B_0$. When control signal $F_n$ is at a low logic level, switch 152N is rendered non-condutive and blocks voltage $B_{0\text{-}N}$. It should be noted that the breaks shown in the output lines of switches 152 through 152N indicate there is a plurality of switches between switch 152 and 152N and that there may be a switch for every component of the product from reactor 15. In this regard, switch means 150A is similar. However, it should be noted, and referring to Table I, that for many of the elements, constant $B_1$ has a zero value. Thus it would not be necessary to have a switch for each zero value but rather have an OR gate receiving those control signals that pertain to the zero value and the output of the OR gate would control a signal switch receiving a zero potential or connected to ground. Switch means 150A receives direct current voltages $B_{1\text{-}1}$ and $B_{1\text{-}N}$ and is controlled by signal $F_1$ and $F_n$ to provide signal $B_1$.

Similarly, switches 150B through 150E are controlled by signals $F_0$ and $F_n$ to provide signals $B_2$ through $B_5$. Although switch means 150I through 150M only receive three direct current voltages each, they operate in a similar manner as switch means 150 in response to control signals $G_1$, $G_2$ and $G_3$. Thus, when control signal $G_1$ is at a high logic level, switch means 150F through 150M provides direct current voltages $C_{0\text{-}1}$ through $C_{7\text{-}1}$ as signals $C_1$ through $C_7$. When control signal $G_2$ is at a high logic level, switching means 150F through 150M provides voltages $C_{0\text{-}2}$ through $C_{7\text{-}2}$ and signals $C_0$ through $C_7$. When control signal $G_3$ is at a high logic level, switching means 150F through 150M provides voltages $C_{0\text{-}3}$ through $C_{7\text{-}3}$ and signals $C_0$ through $C_7$.

Figure 6:
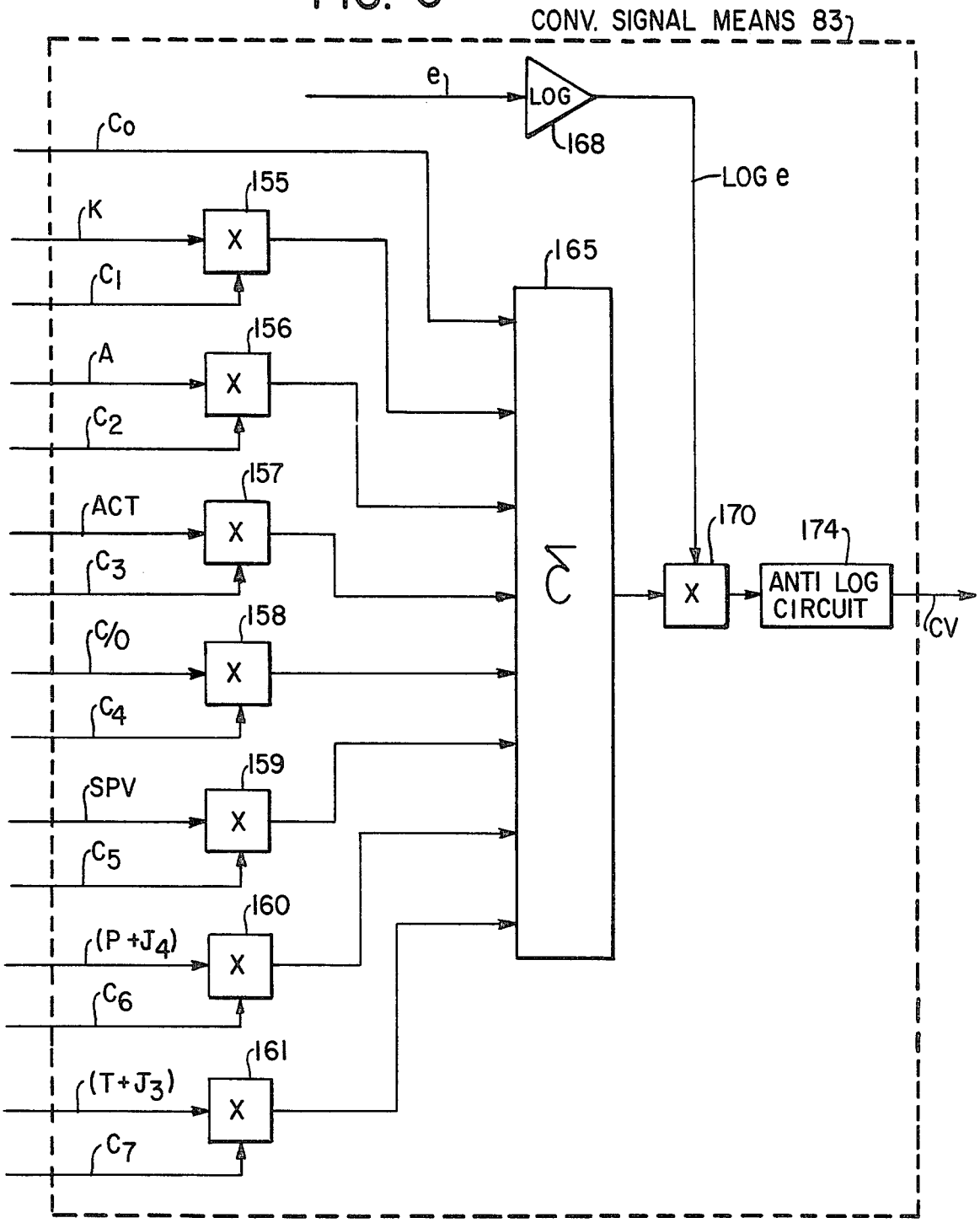

Referring now to FIG. 6, conversion signal means 83 performs equation 4 and includes multipliers 155 through 161 multiplying signals K and A, a direct current voltage ACT and signals C/O, STV, $(P+J^4)$ and $(T+J^3)$ with signals $C_1$ through $C_7$, respectively, to provide product signals to summing means 165 where they are summed with signal $C_0$. Voltage ACT corresponds to the purity of the catalyst. A direct current voltage e is applied to a logarithmic amplifier 168 which provides a signal log e to a multiplier 170. Multiplier 170 multiplies the sum signal provided by summing means 165 with signal log e to provide a signal to a conventional type antilog circuit 174. Antilog circuit 174 provides signal CV.

Referring to FIG. 7, signal A is applied to multipliers 190, 191 in $K_F$ signal means 78. Multiplier 190 multiplies signal A with a direct current voltage $M_2$ corresponding to the constant $M_2$ in equation 1 to provide a product signal to summing means 193. Multiplier 191 effectively squares signal A to provide a product signal which is multiplied with a direct current voltage $M_4$ corresponding to the constant $M_4$ in equation 1 by a multiplier 195. Multiplier 195 provides a signal corresponding to the term $M4A^2$ in equation 1 to summing means 193. Signal V is applied to multipliers 197, 198. Multiplier 197 multiplies signal V with a direct current voltage $M_1$ to provide a signal corresponding to the term $M_1V$ in equation 1 to summing means 193. Multiplier 198 effectively squares signal V to provide a signal which is multiplied with a direct current voltage $M_3$ by a multiplier 200. Multiplier 200 provides a signal corresponding to the term $M_3V^2$ to summing means 193 where it is summed with the signals from multipliers 190, 197 and 197 and a direct current voltage $M_5$ corresponding to the term $M_5$ in equation 1. Summing means 193 provides a signal to a multiplier 204. A direct current voltage e is applied to a logarithmic amplifier 206 which provides a signal log e to multiplier 204. Multiplier 204 multiplies signal log e with the sum signal from summing means 193 to provide a signal to an antilog circuit 210. Antilog circuit 210 provides the signal that is supplied to switch 74C.

Figure 8:
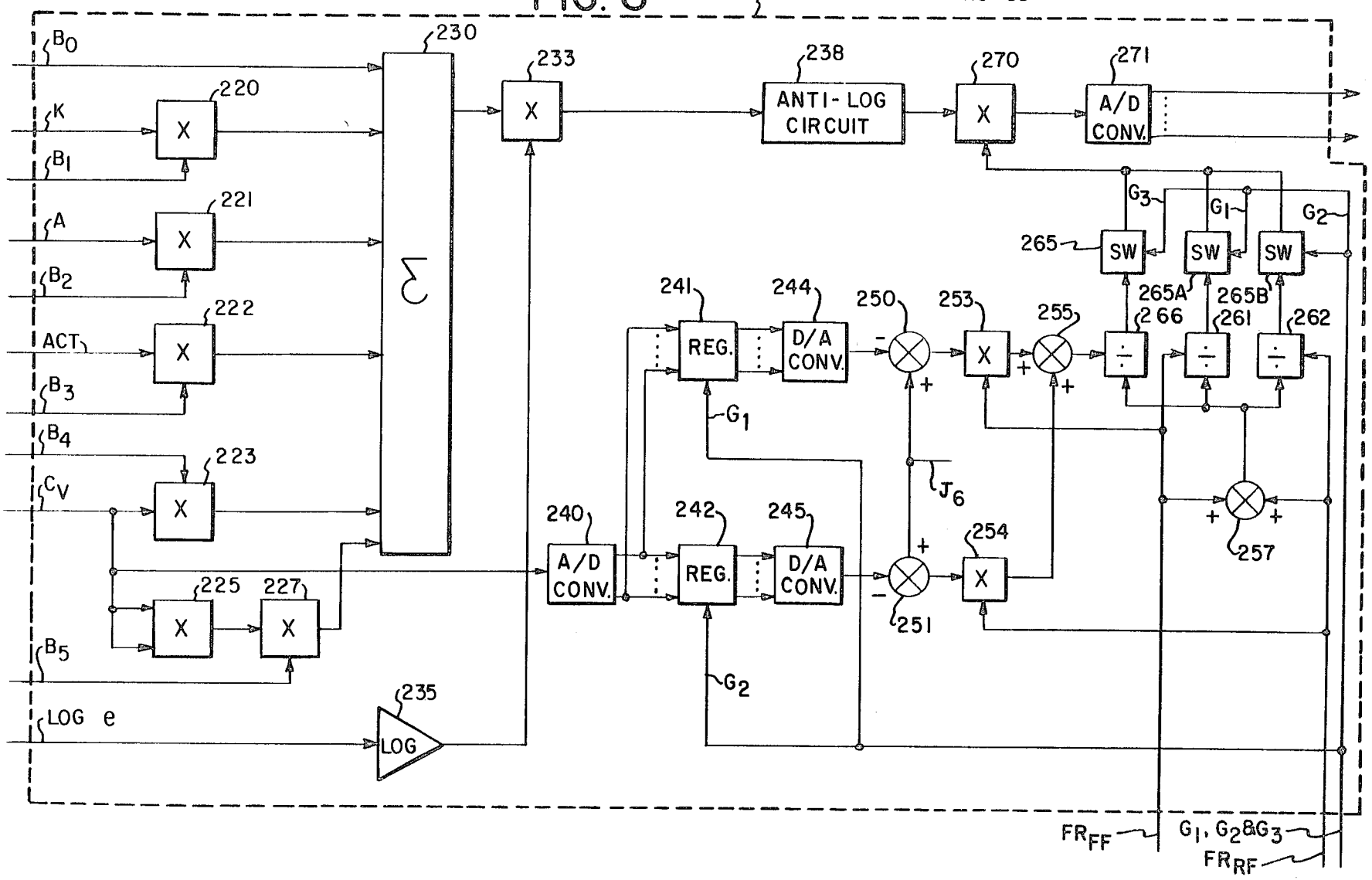

Referring to FIG. 8, yield signal means 85 includes multipliers 220, 221, 222, 223 multiplying signals K, A, voltage ACT and signal CV, respectively, with signals $B_1$ through $B_4$. Signal CV is effectively squared by a multiplier 225 and applied to another multiplier 227 where it is multiplied with signal $B_5$. Summing means 230 sums signal $B_0$ with the signals from multipliers 220 through 223 and 227 to provide a sum signal to a multiplier 233. Voltage e is applied to a logarithmic aplifier 235 which provides a signal log e to multiplier 233 where it is multiplied with the sum signal from summing means 230 to provide a signal to an antilog circuit 238.

Antilog circuit 230 provides a signal corresponding to the yield. However, the signal corresponds to different yields at different times depending on whether it is a yield associated with the fresh feed, a yield associated with the recycle feed or a yield associated with the catalyst bed in reactor 15 and thus must be modified accordingly.

Signal $C_V$ is provided to an analog-to-digital converter 240 which in turn provides digital signals to registers 241, 242. The entrance of the digital signals into registers 241, 242 is controlled by signals $G_1$ and $G_2$, respectively, so that register 241 provides digital signals corresponding to $C_V$ for a fresh feed situation, while register 242 provides digital signals corresponding to $C_V$ for the recycle feed situation. The digital signals from registers 241, 242 are provided to digital-to-analog converters 244 and 245, respectively, which in turn provide corresponding analog signals to subtracting means 250 and 251, respectively, where they are subtracted from a direct current voltage $J_6$ corresponding to a value of 1. The signals from subtracting means 250, 251 are provided to multipliers 253 and 254, respectively, where they are multiplied with signals $FR_{FF}$ and $FR_{RF}$, respectively, to provide product signals which are summed by summing means 255. Signals $FR_{FF}$, $FR_{RF}$ are also summed by summing means 257 to provide a sum signal to dividers 260, 261 and 262. Dividers 260, 261 and 262 divide the sum signal from summing means 257 with the signal from summing means 255, signal $FR_{FF}$ and signal $FR_{RF}$, respectively, to provide corresponding signals to switches 265, 265A and 265B, respectively. Switch 265 is an electronic switch which is the equivalent of a single pole, single throw switch. Switches 265, 265A, 265B are controlled by signals $G_3$, $G_1$ and $G_2$, respectively, and have their outputs tied together so that they effectively select between one of the signals from dividers 260, 261 and 262. The signal provided by switches 265, 265A and 265B is multiplied with the signal from antilog circuit 238 by a multipllier 270 to provide a product signal to analog-to-digital converter 271, which provides the digital signals to registers 110, 110A and 110B.

Figure 9:
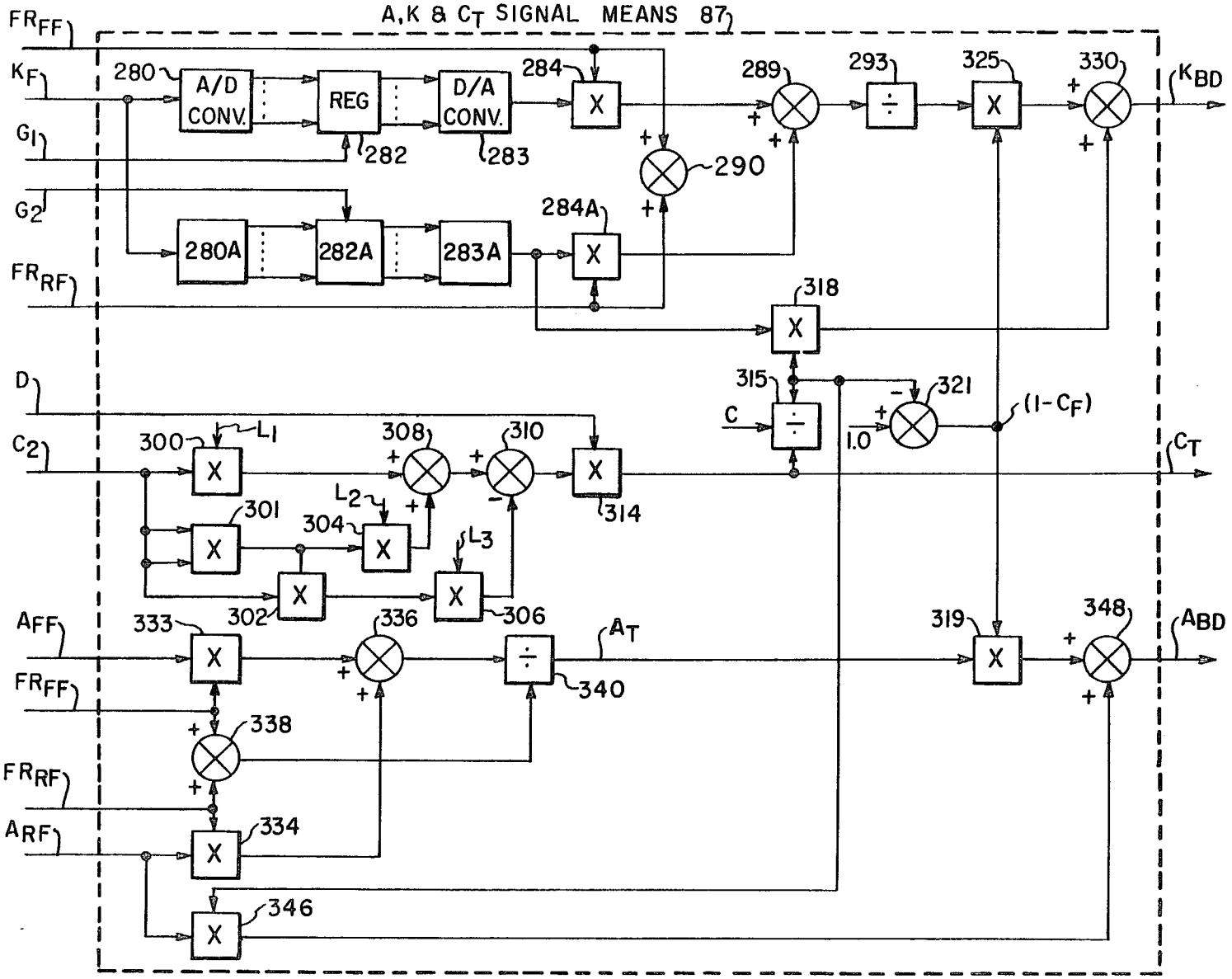

Referring now to FIG. 9, signal means 87 includes analog-to-digital converters 280, 280A, receiving the signal $K_F$ from $K_F$ signal means 78. Converters 280, 280A provide corresponding digital signals, corresponding to the K factor for the fresh feed and the recycle feed, respectively, to registers 282 and 282A, respectively, which are controlled by signals $G_1$ and $G_2$, respectively, to enter the digital signals from converters 280 and 280A, respectively. Registers 282 and 282A provide signals to digital-to-analog converters 283 and 283A which in turn provide corresponding analog signals to multipliers 284 and 284A. Multipliers 284 and 284A multiply the signals from converters 283 and 283A, respectively, with signals $FR_{FF}$ and $FR_{RF}$, respectively, to provide product signals to summing means 289. Summing means 290 sums signals $FR_{FF}$ and $FR_{RF}$ to provide a sum signal which is divided into the sum signal provided by summing means 289 by a divider 293.

Signal $C_L$ is applied to multipliers 300, 301 and 302. Multiplier 300 multiplies signal $C_L$ with a direct current voltage $L_1$ corresponding to the constant $L_1$ in equation 5. Multiplier 301 effectively squares signal $C_L$ and provides it to multipliers 302, 304. Multiplier 304 multiplies the signal with a direct current voltage $L_2$ to provide a signal corresponding to the term $(L_2)(C_L)^2$ in equation 5. Multiplier 302 effectively cubes signal $C_L$ and provides it to a multiplier 306 where it is multiplied with a direct current voltage $L_3$ to provide a signal corresponding to the term $(L_3)(C_L)^3$ in equation 5. Summing means 308 sums the signals from multipliers 300, 304 to provide a sum signal which has the signal from multiplier 306 subtracted from it by subtracting means 310. Subtracting means 310 provides a signal to a multiplier 314 where it is multiplied with signal D to provide signal $C_T$ which is applied to a divider 315 as well as to divider 102 previously mentioned.

Divider 315 divides a direct current voltage C corresponding to the term C in equation 4 to devlop a signal $C_F$ which is applied to a multiplier 318 and to subtracting means 321.

Subtracting means 321 subtracts a direct current voltage corresponding to a value of 1 from signal $C_F$ to provide a signal corresponding to the term $(1-C_F)$ in equations 3 to 7 to multiplier 325. Multiplier 325 multiplies the signals from divider 293 and subtracting means 321 to provide a signal which is summed with the signal from multiplier 318 by summing means 330 to provide signal $K_{BD}$.

Multipliers 333, 334 multiply signals $A_{FF}$ and $A_{RF}$, respectively, with signals $FR_{FF}$ and $FR_{RF}$, respectivley, to provide product signals which are summed by summing means 336. Summing means 338 sums signals $FR_{FF}$ and $FR_{RF}$ to provide a sum signal which is divided by sum signal from summing means 336 by a divider 340 which provides a signal $A_T$ corresponding to the term $A_T$ in equation 6. Multiplier 319 multiplies signal $(1.0-C_F)$ from subtracting means 21 with signal $A_T$ from divider 340 to provide a corresponding product signal.

A multiplier 346 multiplies signal $C_F$ and $A_{RF}$ to provide a signal which is summed with the signal from multiplier 319 by summing means 348 to provide signal $A_{BD}$.

What is claimed is:

1. A yield monitor for a fluid catalytic cracking unit including furnaces preheating fresh feed, which is a gas oil, and recycle feed, which is recycle gas oil, a regenerator which regenerates and provides catalyst, a reactor receiving catalyst from the regenerator and the preheated fresh feed through a fresh feed riser and receiving catalyst from the regenerator and the preheated recycle feed through a recycle feed riser and providing the cracked feed to a fractionator which provides at least two product streams and which provides the recycle feed to one of the furnaces, comprising means for sensing the outlet temperature of the fresh feed riser, the outlet temperature of the recycle feed riser, the top pressure of the reactor, the flow rate of the catalyst being mixed with the fresh feed, the flow rate of the catalyst being mixed with the recycle feed, the catalyst's bed temperature, the level of the catalyst and the density of the catalyst, and the flow rates of the fresh feed and the recycle feed, and providing signals $T_{FF}$, $T_{RF}$, $T_{BD}$, P, $CFR_{FF}$, $CFR_{RF}$, $C_L$, D, $FR_{FF}$, $FR_{RF}$, respectively, corresponding thereto; means for analyzing the fresh feed and the recycle feed and providing signals $A_{FF}$ and $A_{RF}$ corresponding to the API gravity of the fresh feed and the recycle feed, respectively, and for providing signals $V_{FF}$ and $V_{RF}$ corresponding to the viscosity of the fresh feed and the recycle feed, respectively; K signal means connected to the analyzing means for providing a signal K corresponding to the Watson K factor of the fresh feed, the recycle feed and the catalyst in accordance with signal $A_{FF}$, $A_{RF}$, $V_{FF}$, $V_{RF}$, D and $C_L$; means connected to the sensing means, to the analyzer means and to the K signal means for providing signals corresponding to the yields of constituents of the product streams in accordance with signals $T_{FF}$, $T_{RF}$, $T_{BD}$, P, $CFR_{FF}$, $CFR_{RF}$, $C_L$, D, $FR_{FF}$, $A_{FF}$, $A_{RF}$, and K; and means connected to the yield signal means for displaying values of the yields of the constituents in accordance with the yield signals.

2. A monitor as described in claim 1 further comprising control signal means for periodically providing control pulses $G_1$, $G_2$ and $G_3$; and in which the K signal means includes first switching means connected to the analyzer means and to the control signal means for providing signals $V_{FF}$ and $A_{FF}$ as signals $V_F$ and $A_F$, respectivey, when a control pulse $G_1$ occurs and for providing signals $V_{RF}$ and $A_{RF}$, as signals $V_F$ and $A_F$, respectively, when control pulse $G_1$ does not occur, $K_F$ network means connected to the first switching means for providing a signal $K_F$ in accordance with signals $V_F$ and $A_F$, C signal means connected to the sensing means for providing signals $C_T$ and $C_F$ in accordance with signal D and $C_L$, $K_{BD}$ signal means connected to $K_F$ signal means, to the sensing means, to the C signal and control signal means for providing a signal $K_{BD}$, corresponding to the K factor associated with the reactor bed, and $A_{BD}$ signal means connected to the analyzer means and to the sensing means and to the C signal means for providing a signal $A_{BD}$, corresponding to the API gravity of the reactor bed, in accordance with signals $FR_{FF}$, $A_{FF}$, $FR_{RF}$, $A_{RF}$ and $C_F$, and second switching means connected to the $K_F$ signal means, to the $K_{BD}$ signal means, to the first switching means, to the $A_{BD}$ signal means and to the control signal means for providing signals $A_F$ and $K_F$ as signals A and K, respectivey, when the control signal means does not provide a pulse $G_3$ and for providing signals $A_{BD}$ and $K_{BD}$ as signals A and K when the control signal means provides pulse $G_3$.

3. A monitor as described in claim 2 in which the C signal means includes $C_T$ network means connected to the sensing means and receiving direct current voltages $L_1$, $L_2$ and $L_3$ for providing signal $C_T$, corresponding to the catalyst inventory in the reactor, in accordance with signals D and $C_L$, the received voltages and the following equation:

$$C_T=[(L_1)(C_L)+(L_2)^2(L_3)(C_L)^3]D$$

where $L_1$ through $L_3$ are constants, $C_L$ is the level of catalyst in the reactor, and D is the density of the catalyst; and $C_F$ network means connected to the $C_C$ network means and receiving a direct current voltage C for providing signal $C_F$ in accordance with signal $C_T$, the received voltage and the following equation:

$$C_F=C/C_T.$$

4. A monitor as described in claim 3 in which the $A_{BD}$ signal means includes $A_T$ signal means connected to the analyzer means and to sensing means for providing a signal $A_T$, corresponding to the API gravity of the total feed, in accordance with signals $A_{FF}$, $A_{RF}$, $FR_{FF}$ and $FR_{RF}$ and the following equation:

$$A_T=](A_{FF})(FR_{FF})-+(A_{RF})(FR_{RF})]/(FR_{FF}+FR_{RF}).$$

and $A_{BD}$ network means connected to the $A_T$ signal means, to the analyzer means and to the C signal means and receiving a DC voltage corresponding to a value of 1.0 for providing the $A_{BD}$ signal in accordance with signal $A_{RF}$, $A_T$ and $C_F$, the received voltage and the following equation:

$$A_{BD}=(C_F)(A_{RF})+(1.0\text{-}C_F)(A_T).$$

5. A monitor as described in claim 4 in which the $K_F$ network means also receives direct current voltages $M_0$ through $M_4$ for providing the $K_F$ signal in accordance with signals $V_F$ and $A_F$, voltages $M_0$ through $M_4$ and the following equation:

$$K_F=e^{(M0+M1VF+M2AF+M3VF2+M4AF2)},$$

where $M_0$ through $M_4$ are constants.

6. A monitor as described in claim 5 in which the $K_{BD}$ signal means includes $K_T$ and $K_{RF}$ signal means connected to the control signal means, to the $K_F$ network means and to the sensing means for providing a signal $K_T$, corresponding to K factor for the total feed, and a signal $K_{RF}$ in accordance with signals $K_F$, $FR_{FF}$ and $FR_{RF}$, pulses $G_1$ and $G_2$ and the following equation:

$$K_T=](K_{FF})(FR_{FF})+(K_{RF})(FR_{RF})]/(FR_{FF}+FR_{RF})$$

where $K_{FF}$ and $K_{RF}$ are the $K_F$ factors for the fresh feed and recycle feed, respectively, and $K_{BD}$ network means connected to $K_F$ network means, to the $K_T$ and $K_{RF}$ signal means and to the C signal means and receiving a DC voltage corresponding to a value of 1.0 for providing signal $K_{BD}$ in accordance with signals $K_T$, $K_{RF}$ and $C_F$, the received voltage and the following equation:

$$K_{BD}=(C_F)(K_{RF})+(1.0-C_F)K_T.$$

7. A monitor as described in claim 6 in which the control signal means also provides signals $F_o$ through $F_n$ and further comprises memory means connected to the control signal means for providing signals $B_0$ through $B_5$ and $C_0$ through $C_7$ in accordance with control signals $F_0$ through $F_n$ and pulses $G_1$, $G_2$ and $G_3$.

8. A monitor as described in claim 7 in which the control signal means provides control pulses $H_1$, $H_2$ and $H_3$ starting and terminating while control pulses $G_1$, $G_2$ and $G_3$, respectively, are in existence, and the yield signal means includes third switching means connected to the control signal means and receiving signals $T_{FF}$, $T_{RF}$, $T_{BD}$ from the sensing means for providing signal $T_{FF}$ as a signal T when a pulse $G_1$ occurs, providing signal $T_{RF}$ as signal T when a pulse $G_2$ occurs and providing signal $T_{BD}$ as signal T when a pulse $G_3$ occurs, C/O signal means connected to the sensing means and to the control signal means for providing a signal corresponding to the catalyst to oil ratio for fresh feed flow and fresh feed catalyst flow when pulse $G_1$ occurs, for the recycle feed flow and recycle feed catalyst flow when pulse $G_2$ occurs and for the reaction zone feed flow and reaction zone catalyst flow when pulse $G_3$ occurs, in accordance with signals $CFR_{FF}$, $CFR_{RF}$, $FR_{FF}$ and $FR_{RF}$, SPV signal means connected to the sensing means, to the C signal means and to the control signal means for providing a signal SPV corresponding to the space velocity for the fresh feed when a pulse $G_1$ occurs, for the recycle feed when a pulse $G_2$ occurs and for the catalyst when a pulse $G_3$ occurs in accordance with signals $FR_{FF}$, $FR_{RF}$ and $C_T$, conversion signal means connected to the sensing means, to the second switching means, to the C/O signal means, to the SPV signal means, to the third switching means, to the sensing means, for providing a signal CV in accordance with signals A, K, SPV, C/O, P, T and $C_0$ through $C_7$; yield circuit means connected to the sensing means, to the second switching means, to the conversion signal means and to the memory means for providing digital signals corresponding to a partial yield of a constituent in accordance with signals $FR_{FF}$, $FR_{RF}$, A, K, CV and $B_0$ through $B_5$ and pulses $G_1$, $G_2$ and $G_3$; and output means connected to the yield circuit means and to the control signal means for providing the yield signals in accordance with the digital signals from the yield network means and pulses $H_1$, $H_2$ and $H_3$.

9. A monitor as described in claim 8 in which the conversion signal means also receives DC voltages ACT, e, $J_3$ and $J_4$, corresponding to the purity of the catalyst, to the mathematical constant e, for providing the conversion signal CV in accordance with received voltages, signals A, K, SPV, C/O, P, T and $C_0$ through $C_7$ and the following equation:

$CV =$

-continued $$e^{[C0+C1K+C2A+C3(ACT)+C4(C/O)+C5(SPV)+B6(P+J4)+C7(T+J3)]}.$$

where $C_0$ through $C_7$ are constants and ACT is a catalyst parameter.

10. A monitor as described in claim 9 in which the yield circuit means includes Y signal means connected to the second switching means, to the memory means and to the CV signal means and receiving DC voltages ACT and e for providing a signal Y in accordance with signals A, K, CV and $B_0$ through $B_5$, voltages ACT and e and the following equation:

$$\text{Yield} = Y[(FR_{FF}/(FR_{FF} + FR_{RF})] + Y(FR_{RF}/(FR_{FF} + FR_{RF})] + Y[FR_{RF}/(FR_{FF} + FR_{RF})].$$

11. A monitor as described in claim 10 further comprising means connected to the yield network means for providing a display of the yields of the constituents of the product leaving the fluid catalytic cracking unit.

* * * * *